US008907236B2

(12) United States Patent
Mittelstadt et al.

(10) Patent No.: US 8,907,236 B2
(45) Date of Patent: Dec. 9, 2014

(54) FLOATING STATIONARY CONTACT TO CREATE STABLE, LOW RESISTANCE CONTACT JOINTS

(75) Inventors: Chad R. Mittelstadt, Cedar Rapids, IA (US); Jeff Kaufman, West Liberty, IA (US); Frank T. Ehrenberger, North Liberty, IA (US)

(73) Assignee: Schneider Electric USA, Inc., Palatine, IL (US)

( * ) Notice: Subject to any disclaimer, the term of this patent is extended or adjusted under 35 U.S.C. 154(b) by 267 days.

(21) Appl. No.: 13/425,986

(22) Filed: Mar. 21, 2012

(65) Prior Publication Data

US 2013/0248335 A1 Sep. 26, 2013

(51) Int. Cl.
*H01H 1/14* (2006.01)

(52) U.S. Cl.
USPC ..... 200/239; 200/248

(58) Field of Classification Search
USPC ..... 200/239, 244, 248
See application file for complete search history.

(56) References Cited

U.S. PATENT DOCUMENTS

| | | | | |
|---|---|---|---|---|
| 1,959,224 A | | 5/1934 | Trancham | 218/107 |
| 2,209,567 A | | 7/1940 | Ives et al. | |
| 2,214,530 A | * | 9/1940 | Janser | 200/248 |
| 2,234,346 A | | 3/1941 | Ives | |
| 2,939,905 A | | 6/1960 | Canfield | 174/71 |
| 3,383,486 A | | 5/1968 | Powell | 200/250 |
| 3,566,318 A | | 2/1971 | Gelzheiser et al. | 335/39 |
| 3,683,107 A | | 8/1972 | Camras | 386/306 |
| 3,706,056 A | | 12/1972 | Chabot | |
| 3,864,652 A | * | 2/1975 | Zubaty et al. | 335/194 |
| 3,908,110 A | | 9/1975 | Heft | 219/121.69 |
| 3,999,103 A | | 12/1976 | Misencik et al. | 361/45 |
| 4,144,554 A | | 3/1979 | Erickson | 361/637 |
| 4,266,210 A | | 5/1981 | Mrenna et al. | 335/201 |
| 4,810,213 A | | 3/1989 | Chabot | 439/825 |
| 6,265,680 B1 | * | 7/2001 | Robertson | 200/293 |
| 6,323,448 B1 | * | 11/2001 | Seymour et al. | 200/237 |
| 8,035,047 B2 | * | 10/2011 | Raabe et al. | 200/238 |

FOREIGN PATENT DOCUMENTS

FR 494131 8/1919

OTHER PUBLICATIONS

International Search Report mailed Jun. 21, 2013 which issued in corresponding International Patent Application No. PCT/US2013/029595 (4 pages).
Written Opinion mailed Jun. 21, 2013 which issued in corresponding International Patent Application No. PCT/US2013/029595 (7 pages).

* cited by examiner

*Primary Examiner* — Kyung Lee
(74) *Attorney, Agent, or Firm* — Locke Lord LLP

(57) ABSTRACT

A floating contact assembly for use in a circuit breaker includes a contact, a floating member, a bearing element, a jaw member, and a flexible conductor. The floating member includes a joint surface and the contact is electrically connected to a surface of the floating member opposite the joint surface. The bearing element is configured to abut the joint surface of the floating member such that the floating member is configured to rotate about a first axis that passes through the bearing element. The jaw member is configured to electrically connect the floating contact assembly to an external electrical component and the flexible conductor electrically couples the jaw member to the floating member.

21 Claims, 8 Drawing Sheets

FLOATING STATIONARY CONTACT TO CREATE STABLE, LOW RESISTANCE CONTACT JOINTS

FIELD OF THE INVENTION

This invention is directed generally to a circuit breaker, and, more particularly, to a circuit breaker having a floating stationary contact.

BACKGROUND OF THE INVENTION

Circuit breakers provide automatic and manual current interruption to a circuit. The act of turning ON a circuit breaker and closing an electrical circuit typically involves a mechanical movement of a series of mechanical parts that results in a moveable contact making an electrical connection with a stationary contact. Because the moveable and stationary contacts are initially brought into physical contact with one another when the circuit breaker is turned ON, arcing can occur therebetween which, over time, can damage the contacts and can reduce the useful life of the circuit breaker. Similar arcing and damage can occur when the moveable and stationary contacts are disconnected in response to the circuit breaker turning OFF. Additionally, due to the nature of imperfections of the contacts, especially when damaged from arcing, for example, a planar engagement between the exposed surfaces of the contacts is not always established.

Thus, a need exists for an improved apparatus. The present disclosure is directed to satisfying one or more of these needs and solving other problems.

SUMMARY OF THE INVENTION

A circuit breaker of the present disclosure is switched from its OFF position to its ON position thereby causing a movable contact blade and attached moveable contact to engage a floating contact assembly of the present disclosure. The floating contact assembly self-adjusts such that the moveable contact engages the contact of the floating contact assembly in a planar fashion (e.g., at least three points of contact between the contacts). The floating contact assembly self-adjusts by the contact rotating about one or more axes of a bearing element.

The floating contact assembly is biased into a first position prior to being engaged by the moveable contact such that a top half of the moveable contact engages a top half of the contact of the floating contact assembly at a single point of contact. Such an engagement concentrates any damage associated with any arcing that occurs between the contacts generally to the top halves of the contacts, which leaves the bottom halves of the contacts generally undamaged and able to provide low resistance electrical points of connection therebetween.

Additionally, when the circuit breaker is switched from its ON position to its OFF position, the floating contact assembly self-adjusts back to its biased original position such that the contacts disconnect from a single point of contact instead of from a planar contact (e.g., at least three points). Such a disengagement of the contacts further concentrates any damage associated with arcing occurring between the contacts during disengagement generally to the top halves of the contacts.

Additional aspects of the disclosure will be apparent to those of ordinary skill in the art in view of the detailed description of various implementations, which is made with reference to the drawings, a brief description of which is provided below.

BRIEF DESCRIPTION OF THE DRAWINGS

The present disclosure may best be understood by reference to the following description taken in conjunction with the accompanying drawings, in which.

DETAILED DESCRIPTION OF THE ILLUSTRATED EMBODIMENTS

Although the present disclosure will be described in connection with certain preferred implementations of the disclose concepts, it will be understood that the present disclosure is not limited to those particular implementations. On the contrary, the present disclosure is intended to include all alternatives, modifications and equivalent arrangements as may be included within the spirit and scope of the present disclosure as defined by the appended claims.

Figure 1:
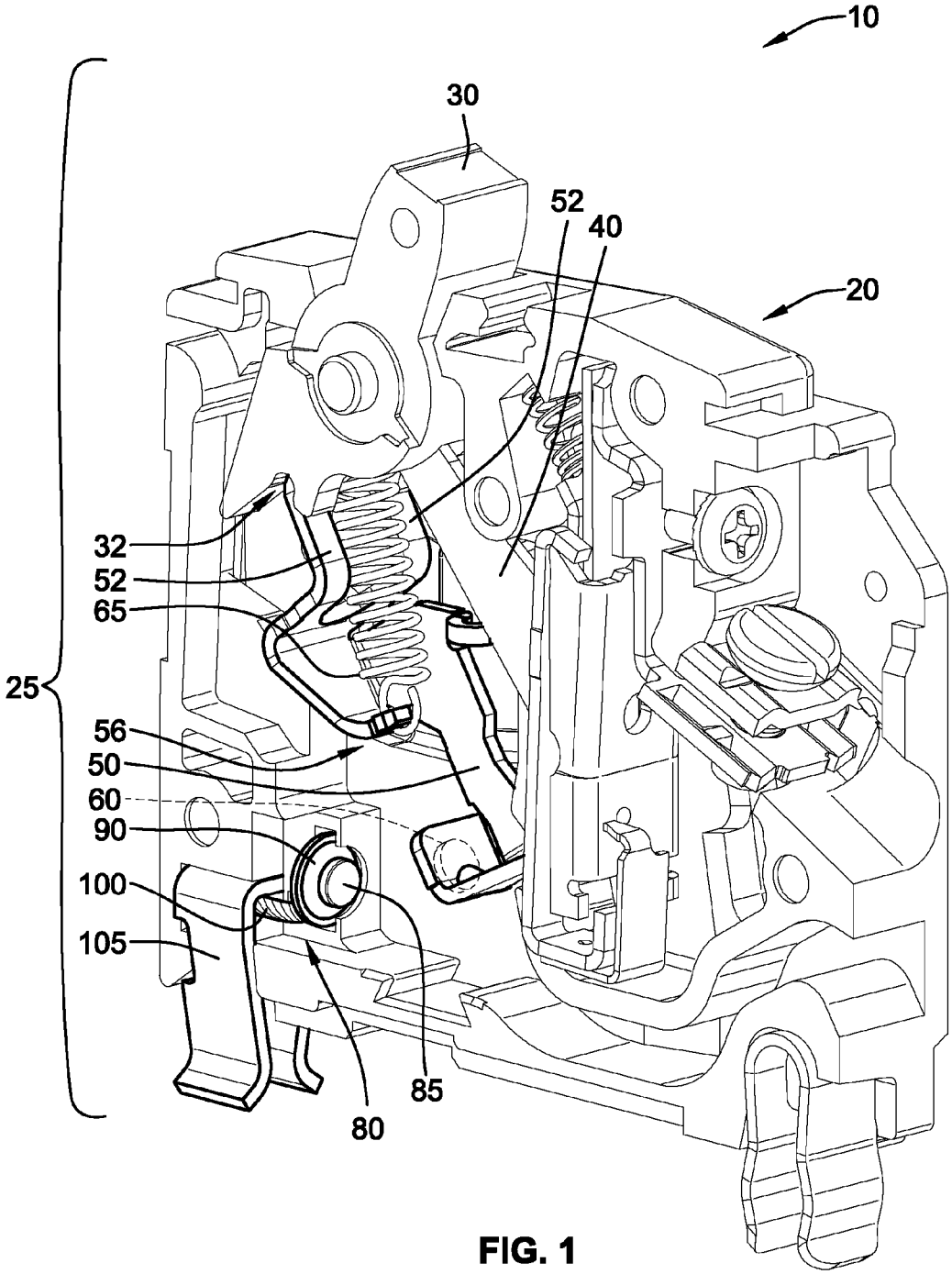
FIG. 1 is a partial perspective view of a miniature circuit breaker having a cover removed to illustrate its inner components according to some aspects of the present disclosure.

Referring to FIG. 1, a circuit breaker 10 with a cover removed (i.e., not shown) to illustrate internal components includes a housing 20 and a switch assembly 25. The switch assembly 25 is generally contained within the housing 20, except for a portion of the switch assembly 25 (e.g., an upper portion of a handle 30 and a lower portion of a jaw member 105). Some components (e.g., bimetal, yoke, armature, terminals, etc.) of the circuit breaker 10 are omitted or not described, however, these components, which may be found in, for example, the QO® or HOMELINE® miniature circuit breakers available from Schneider Electric USA, Inc., are not necessary for an understanding of aspects of the present disclosure.

As shown in FIG. 1, the switch assembly 25 includes a handle 30, a trip lever 40, a moveable conductive blade 50, a moveable contact 60 (shown in phantom), a spring 65, and a floating contact assembly 80. Portions of the switch assembly 25 are operable to move or switch the circuit breaker 10 on, where current is free to flow through the circuit breaker 10, and off, where current is prevented from flowing through the circuit breaker 10. More specifically, for current to pass through the circuit breaker 10, the circuit breaker 10 is switched to a latched-ON position (FIG. 5C), meaning that the handle 30 is in an ON position (not shown) and the trip lever 40 is in an engaged position (see e.g., FIG. 1).

The trip lever 40 can be in a tripped position (not shown) which prevents the circuit breaker 10 from returning to an ON position without operating the handle 30. However, for the purposes of this disclosure, the trip lever 40 is in the engaged position as shown in FIG. 1. Thus, assuming the trip lever 40 is in the engaged position, the on/off state of the circuit breaker 10 is generally controlled by the position of the handle 30 for purposes of this disclosure. To prevent current from flowing through the circuit breaker 10, the circuit breaker 10 can be switched to a latched-OFF position, meaning that the handle 30 is in an OFF position (see e.g., FIG. 1) and the trip lever 40 is in the engaged position.

The moveable conductive blade 50 is operatively coupled to the trip lever 40 and to the handle 30 such that the moveable conductive blade 50 is configured to move or swing from an off or first blade position (e.g., FIG. 1) to an on or second blade position (e.g., FIG. 5C) in response to the handle 30 being urged from the OFF position (e.g., FIG. 1) to the ON position (handle not shown in the ON position). That is the OFF and ON positions of the handle 30 correspond to the first and second blade positions, respectively, of the moveable conductive blade 50.

By operatively coupled it is meant that the moveable conductive blade 50 is mechanically linked to the both the handle 30 and the trip lever 40 such that movement of the handle 30 results in a corresponding movement of the moveable conductive blade 50. Specifically, the moveable conductive blade 50 is coupled to the trip lever 40 via the spring 65, and the moveable conductive blade 50 is pivotally coupled to the handle 30. The spring 65 is attached and/or coupled to an attachment point 56 on the moveable conductive blade 50 and to a similar attachment point (not shown) on the trip lever 40 to bias the moveable conductive blade 50 such that the moveable conductive blade 50 generally maintains the pivotal coupling with the handle 30. More specifically, the spring 65 biases a pair of blade arms 52 into pivotal contact with one or more handle grooves 32.

Figure 3A:
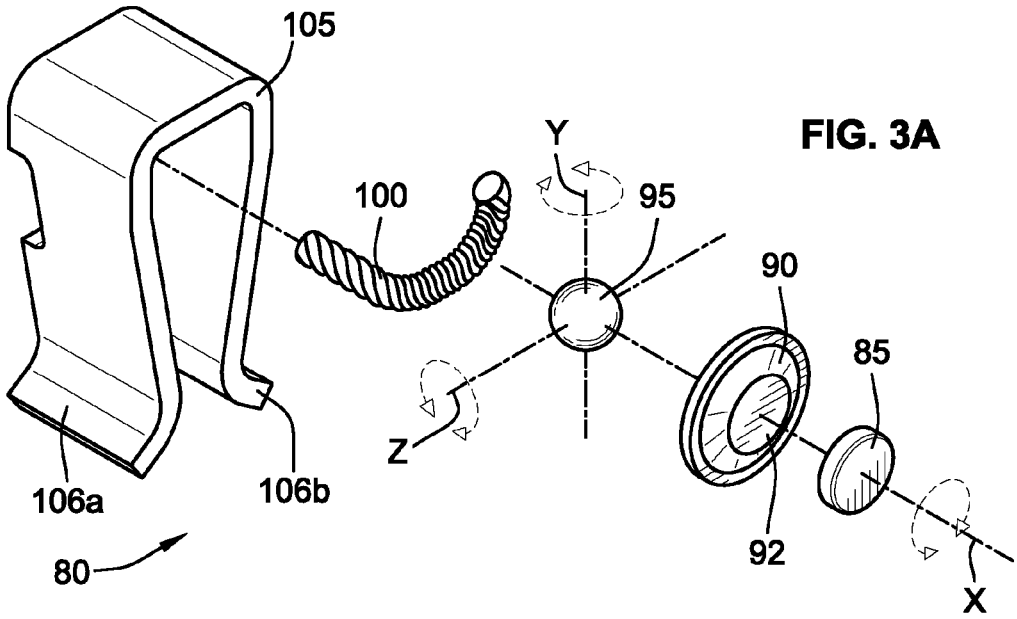
FIGS. 3A and 3B are exploded perspective views of the floating contact assembly of the circuit breaker of FIG. 1.
Figure 3B:
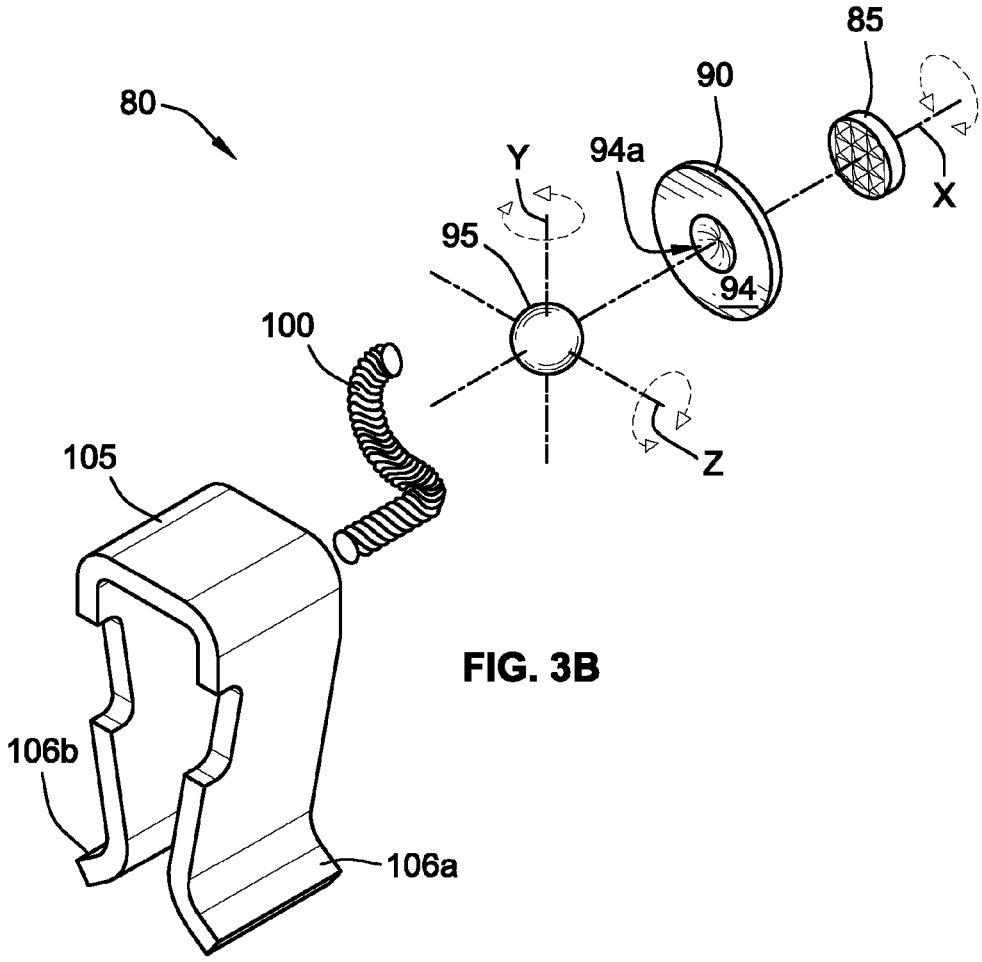

As best shown in the two exploded views of the floating contact assembly 80 of FIGS. 3A and 3B, the floating contact assembly 80 includes a contact 85, a floating member or disc 90, a bearing element 95, a flexible conductor 100, and a jaw member 105. By the term "floating" it is meant, for example, that at least one component of the floating contact assembly 80 is not fixed or stationary within the housing 20 of the circuit breaker 10 as compared to a fixed or stationary contact assembly in a standard circuit breaker (not shown) where each component of the fixed or stationary contact assembly (which typically includes a jaw and a stationary contact) does not move with respect to the housing. More specifically, by the term floating it is meant, for example, that the floating member 90 has at least one rotational degree of freedom (e.g., one degree of rotational freedom, two degrees of rotational freedom, or three degrees of rotational freedom) about at least one axis (e.g., an X axis, a Y axis, a Z axis, or a combination thereof) that passes through the bearing element 95 and/or the housing 20 such that the floating member 90 is free to move with respect to the housing 20 of the circuit breaker. Put another way, the term "floating" can mean that the floating member 90 orbits around one or more points in or on the bearing element 95 and/or in or on the housing 20.

Figure 2:
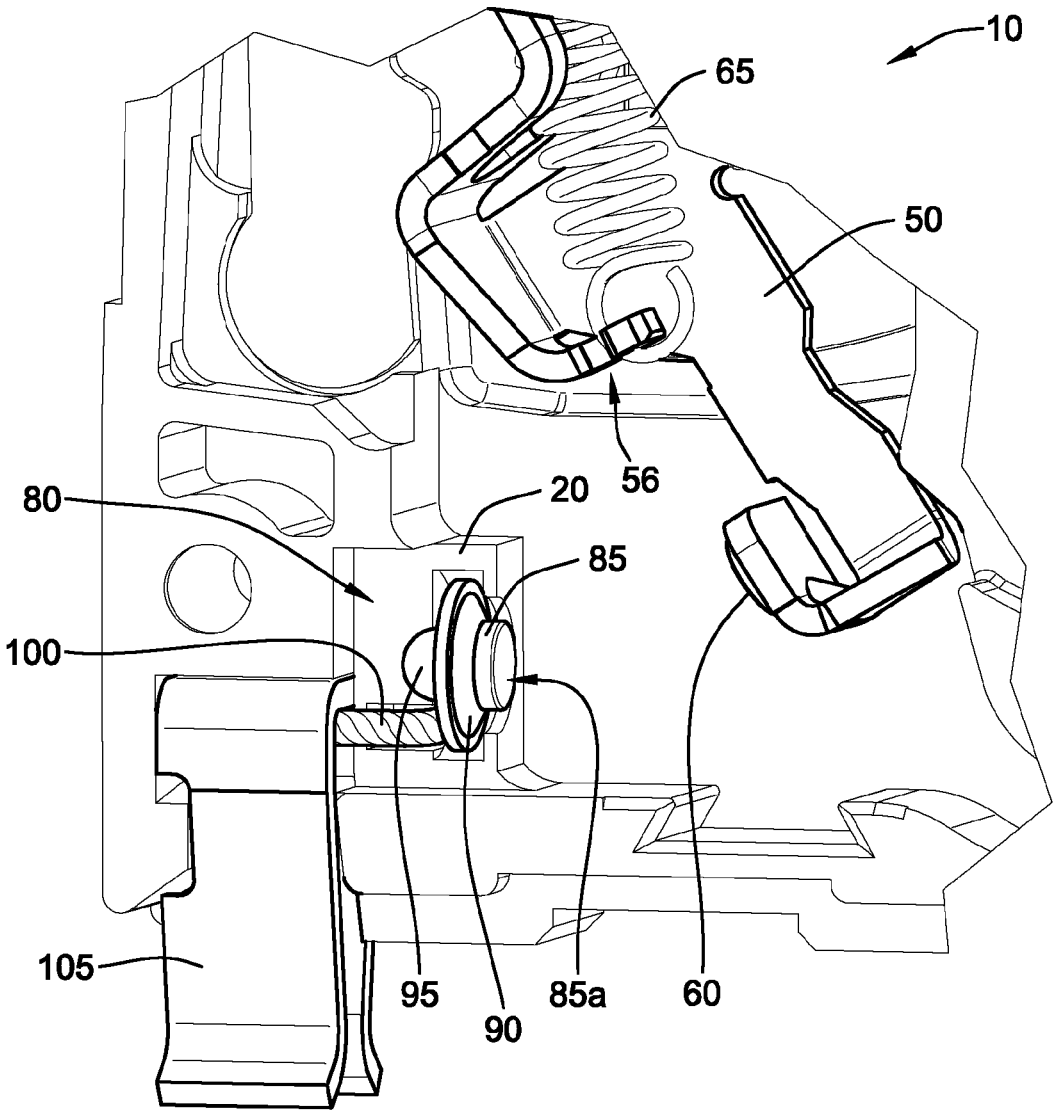
FIG. 2 is an enlarged partial perspective view of a portion of the circuit breaker of FIG. 1 highlighting a floating contact assembly.
Figure 5B:
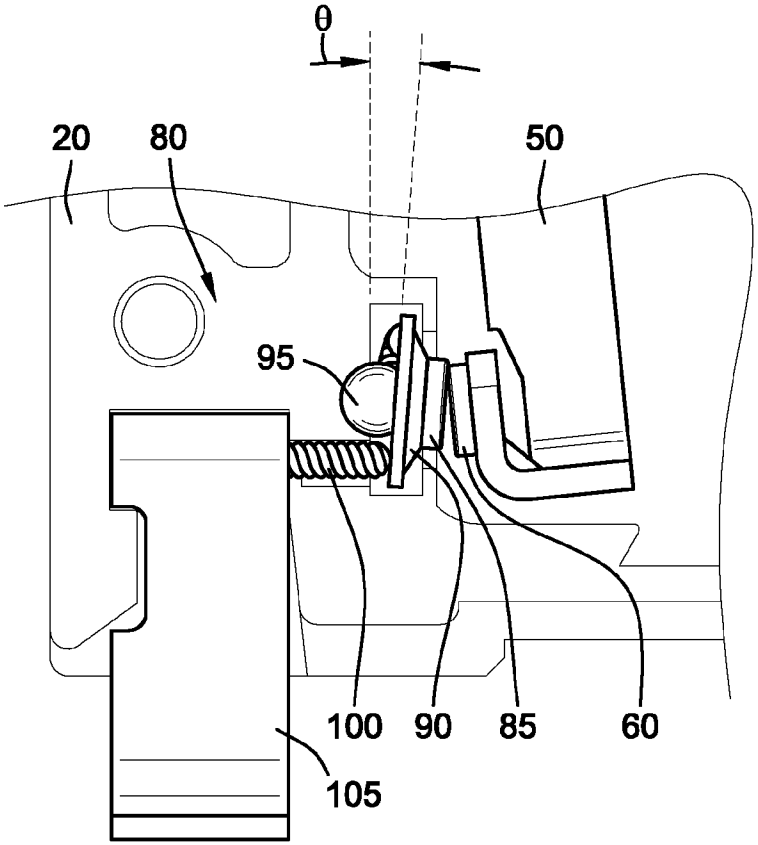
FIGS. 5A-5C are partial front views of the circuit breaker of FIG. 1 illustrating a moveable contact coming into contact with the floating contact assembly.
Figure 5A:
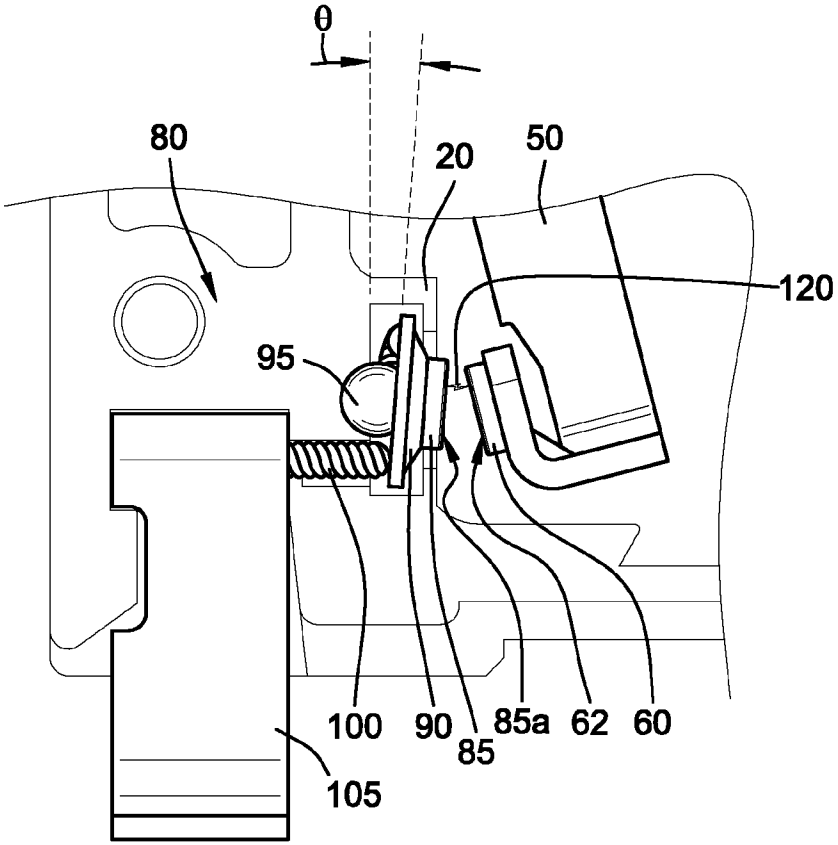
Figure 5C:
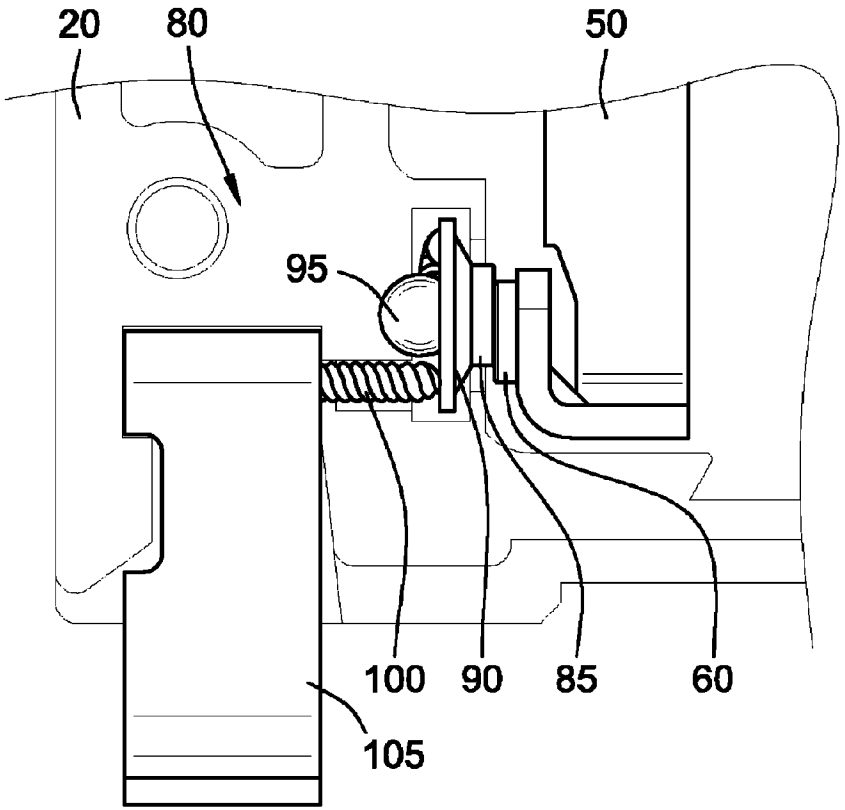

As best shown in FIG. 2, the contact 85 is physically and electrically coupled to the floating member or disc 90. More specifically, the contact 85 is attached to a contact-connecting surface 92 (see e.g., FIG. 3A) of the floating member 90. The contact 85 can be attached to the contact-connecting surface 92 of the floating member 90 by any means known in the art for attaching two electrically conducting components, such as, for example, welding (e.g., tack welding and/or arc welding), press-fitting, gluing, etc. The contact-connecting surface 92 can be flat, partially-flat, tapered, partially-tapered, a combination thereof, etc. As best shown in FIGS. 5A-5C, the contact-connecting surface 92 (FIG. 3A) includes a tapered portion such that the contact 85 partially protrudes from a floating-contact-assembly cavity 22 of the housing 20. Alternatively, to the floating member 90 and the contact 85 being distinct and separate components, the floating member 90 and the contact 85 can be formed as a single integral and/or unitary component (e.g., the floating member 90 and the contact 85 are made of the same material and/or formed by one mold).

The flexible conductor 100 is physically and electrically coupled to the floating member 90 and to the jaw member 105 such that the flexible conductor 100 electrically connects the jaw member 105 to the floating member 90. The flexible conductor 100 can be called an electrical wire, a braided wire, a pigtail conductor, etc. The flexible conductor 100 can be made from any electrically conducting material, such as, for example, copper, gold, silver, tungsten carbide, any combination thereof, etc. The flexible conductor 100 can be physically attached to the jaw member 105 and the floating member 90 by any means known in the art for attaching two electrically conducting components.

As best shown in FIGS. 3A and 3B, the jaw member 105 includes a pair of legs 106*a,b* that is configured to receive therebetween, and/or electrically connect the floating contact assembly 80 to, an external electrical component, such as, for example, a terminal, a source of electrical power (e.g., busbar in an electrical panel), etc. The flexible conductor 100 also provides a mechanical separation of the contact 85 and the jaw member 105. Such a mechanical separation is advantageous, for example, because movement of components (e.g., vibration of an electrical panel or enclosure) that the circuit breaker 10 is attached to have less, if any, of an impact on the mechanical and is electrical connection between the contact 85 and the moveable contact 60 when the circuit breaker is in the on position.

In addition to electrically connecting the floating member 90 and the jaw member 105, the flexible conductor 100 can act as a spring so as to exert a force on the floating member 90. For example, as shown in FIG. 5A, when the circuit breaker is off (e.g., the moveable contact 60 and the contact 85 are not electrically connected), the flexible conductor 100 can bias the floating member 90 such that the floating member 90 is in a first rotated position. In the first rotated position, the floating member 90 is rotated about the Z axis such that the floating member 90 is at an angle, θ, with respect to the vertical. The angle, θ, can be between about zero degrees and about forty-five degrees. In addition to, or alternatively to the flexible conductor 100 acting as a spring, one or more separate and distinct springs (not shown) can be positioned within the circuit breaker 10 to bias the floating member 90 in a first rotated position (e.g., when the circuit breaker is off) where the floating member 90 can be rotated about one or more of the X, Y, and Z axes (shown in FIGS. 3A and 3B). As described herein, the floating member 90 can move and/or rotate from the first rotated position to a second rotated position as shown in FIG. 5C due to, for example, a force exerted on the contact 85 by the moveable contact 60 and/or the moveable conductive blade 50.

Figure 4:
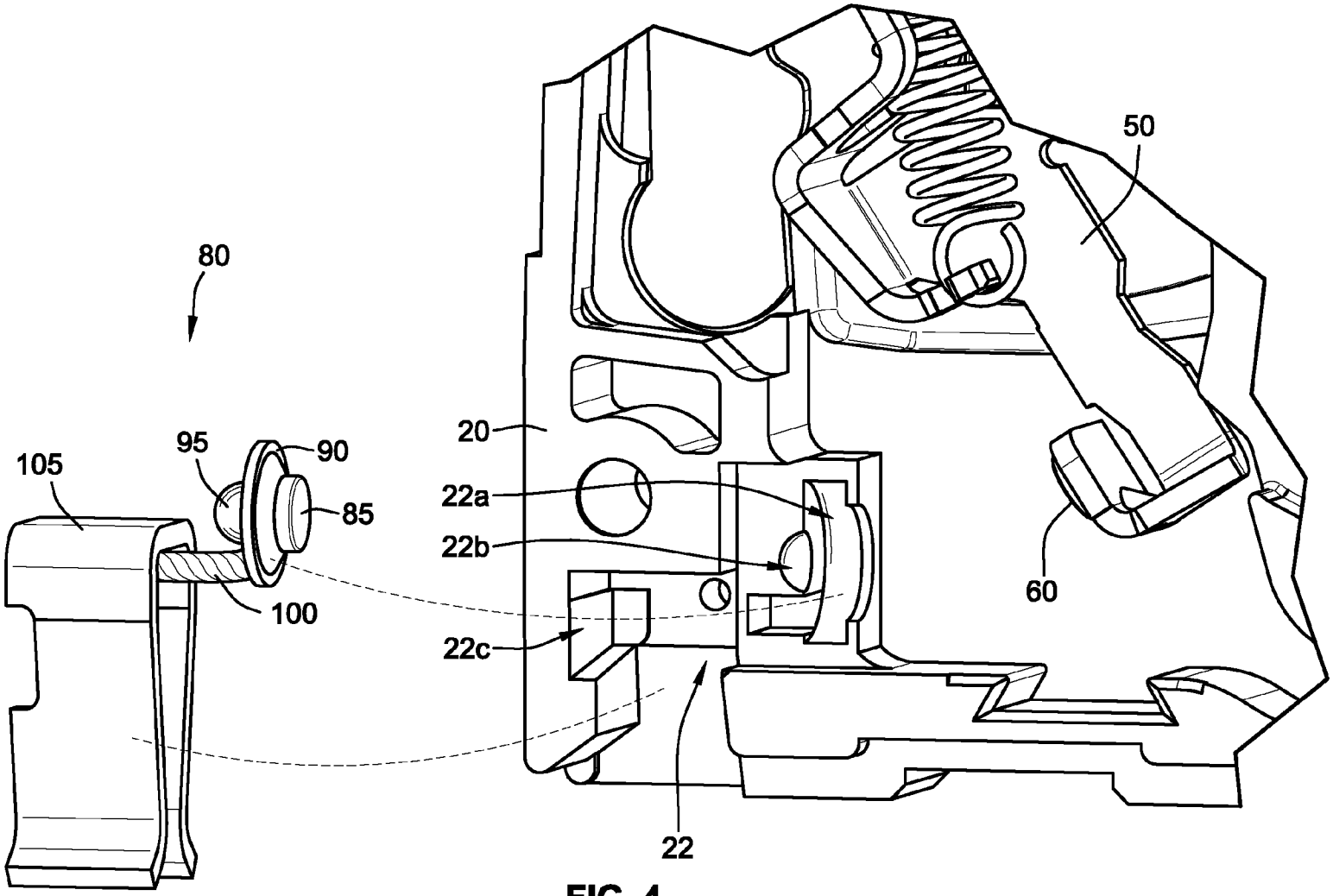
FIG. 4 is a partially exploded perspective view of the floating contact assembly and a portion of the housing of the circuit breaker of FIG. 1.

As best shown in the assembled configuration of the floating contact assembly 80 of FIG. 4, the floating member 90 is coupled to the bearing element 95. More specifically, a bearing and/or joint surface 94 (see e.g., FIG. 3B) abuts and/or contacts a portion of the bearing element 95. The bearing element 95 can be formed of an electrically conducting material and/or a non-electrically conducting material (i.e., electrically insulating). In the case of the bearing element 95 being non-electrically conducting, the bearing element 95 can be formed from an elastomer or dampening material that can aid in controlling contact bounce. Contact bounce can occur in response to the moveable contact 60 engaging the contact 85 with a sufficient force such that the moveable contact 60 and attached moveable conductive blade 50 bounce back, which can undesirably cause an arc to occur between the contacts 60 and 85. An elastomer or dampening bearing element 95 can aid in reducing such contact bounce by absorbing at is least a portion of the force exerted on floating contact assembly 80 and the contact 85 by the moveable contact 60 and the attached moveable conductive blade 50.

As shown, the joint surface 94 (FIG. 3B) includes a concave portion 94*a* for at least partially receiving the bearing element 95 therein. The concave portion 94*a* is sized and shaped to receive the bearing element 95 such that the floating member 90 can rotate in a spherical fashion about the bearing element 95. By rotating in a spherical fashion, it is meant that the floating member 90 can rotate in all three degrees of freedom about a center or origin of the bearing element 95. That is, the floating member 90 is free to rotate about the X, Y, and Z axes, positioned through the center of the bearing element 95, as illustrated in FIGS. 3A and 3B.

It is appreciated that the X, Y, and Z axes, about which the floating member 90 can rotate, can be positioned in any spatial location as the sizes and shapes of the floating member 90 and of the bearing element 95 are modified. For example, the bearing element 95 can have a substantially spherical shape (e.g., as shown in the figures), a generally spherical shape, a semi-spherical shape, an oval shape, a semi-oval shape, a cylindrical shape, a semi-cylindrical shape, a conical shape, a semi-conical shape, a pyramidal shape, a semi-pyramidal shape, a cone shape, a semi-cone shape, a triangular shape, a semi-triangular shape, a round shape, a semi-round shape, any combinations thereof, etc. Depending on the shape of the bearing element 95, the joint surface 94 can have a corresponding portion (e.g., portion 94*a*) to facilitate movement and/or rotation of the floating member 90 relative to the bearing element 95 such that the floating contact assembly 80 can self-adjust as described herein.

As best shown in FIG. 4, the abutting and/or contact coupling of the floating member 90 and the bearing element 95, when the floating contact assembly 80 is in the assembled position, is generally maintained by the housing 20 of the circuit breaker 10. More specifically, the housing 20 includes the floating-contact-assembly cavity 22 that is sized and shaped to receive at least a portion of the floating contact assembly 80 therein. The floating-contact-assembly cavity 22 is generally formed by the housing 20 and the cover (not shown) of the circuit breaker 10. The floating-contact-assembly cavity 22 includes one or more portions and/or sections to accommodate the various elements of the floating contact assembly 80. The floating-contact-assembly cavity 22 at least is includes, for example, a floating-member-cavity portion 22*a*, a bearing-element-cavity portion 22*b*, and a jaw-member-cavity portion 22*c*. Each of the cavity portions 22*a-c* is formed by one or more walls and/or surfaces of an interior of the housing 20 and/or cover (not shown) to hold the respective components of the floating contact assembly 80 therein when the housing 20 and the cover (not shown) are attached and to at least allow the floating member 90 and attached contact 85 to move and/or rotate as described herein.

The floating-contact-assembly cavity 22 is generally shaped and sized such that the floating member 90 and the bearing element 95 generally remain in contact, although it is possible according to some implementations of the disclosed concepts for the floating member 90 and the bearing element 95 to become separated within the floating-contact-assembly cavity 22, such as, for example, when the circuit breaker 10 is off and the moveable contact 60 is not engaged with the contact 85. Such an implementation can allow the floating member 90 and attached contact 85 and/or the bearing element to translate linearly within the floating-contact-assembly cavity 22.

The floating-contact-assembly cavity 22 is sized such that the floating member 90 can at least partially rotate in all three degrees of freedom about the bearing element 95 as described herein. By partially rotate, it is meant that the floating member 90 can rotate less than 360 degrees about the X, Y, and Z axes of the bearing element 95. For example, depending on the relative sizes and shapes of the floating member 90, the bearing element 95, and the floating-contact-assembly cavity 22, the floating member 90 can rotate between about negative forty-five and positive forty-five degrees about each of the X, Y, and Z axes from a vertically-squared position (e.g., as shown in FIGS. 3A and 3B). For another example, the floating member 90 can rotate between about negative twenty and positive twenty degrees about each of the X, Y, and Z axes from the vertically-squared position. For yet another example, the floating member 90 can rotate between about negative five and positive five degrees about each of the X, Y, and Z axes from the vertically-squared position. The limits on the rotation of the floating member 90 are generally due to the geometry of the floating-contact-assembly cavity 22 and the housing 20 forming the same.

While the floating member 90 is described as being free to rotate about the X, Y, and Z axes, in some implementations of the disclosed concepts, the floating member 90 is free to partially rotate about two orthogonal axes with two rotational degrees of freedom, such as, for example, the Y and Z axes due to, for example, the attachment of the flexible conductor 100 to the floating member 90. In some such implementations, the flexible conductor 100 is designed such that rotation of the floating member 90 about the X axis is merely constrained but not completely limited to zero rotation thereabout.

When the circuit breaker 10 is on, e.g., the handle 30 is in the ON position and the moveable conductive blade 50 is in the on or second blade position (e.g., FIG. 5C), current flowing into the circuit breaker 10 through the floating contact assembly 80 is free to flow through the moveable contact 60, which is removably coupled to and abuts and/or electrically connects with the contact 85. The moveable contact 60 is fixed to and/or directly attached to the moveable conductive blade 50 such that current is free to flow from the moveable contact 60 through the moveable conductive blade 50. When the circuit breaker is off, i.e., the handle 30 is in the OFF position and the moveable conductive blade 50 is in the off or first blade position (e.g., FIG. 1), the moveable contact 60 is disconnected or spaced away from the contact 85 a sufficient distance to prevent current from flowing therethrough.

As shown in FIG. 5A, in response to the circuit breaker 10 being switched from off to on, the moveable conductive blade 50 moves from the first blade position (FIG. 1) to the second blade position (FIG. 5C). As the moveable conductive blade 50 approaches the second blade position, the moveable contact 60 is moved into a close, but spaced, relationship with the contact 85 for an instantaneous moment in time captured in FIG. 5A. As discussed herein, the floating member 90 is biased to be at an angle, θ, with respect to the vertical, by, for example, the flexible conductor 100 and or one or more springs (not shown). Similarly, as shown in FIG. 5A, due to, at least in part, the geometry of the switch assembly 25, the moveable contact approaches in a non-vertical orientation.

At some point prior to the moveable and floating contacts 60, 85 physically touching (FIG. 5B), an arc 120 typically will occur between the contacts 60, 85, as shown in FIG. 5A. Over time, the arcing 120 can damage the contacts 60, 85 which can result in higher electrical resistance paths being developed between the contacts 60, 85. The initial angled approach and angled physical touching between the moveable contact 60 and the contact 85 surprisingly results in the arcing, and damage associated therewith, being contained generally to the upper halves of an exposed face 62 of the moveable contact 60 and an exposed face 85*a* of the contact 85. Thus, over time, generally the bottom halves of the exposed faces 62, 85*a* of the contacts 60, 85 remain undamaged due to the arcing, which can occur when the circuit breaker 10 is switched from off to on and/or when the circuit breaker 10 is switched from on to off (e.g., the opposite movement than what is shown and described relative to FIGS. 5A-5C). That is, the closing and the opening/separating of the contacts 60, 85 can result in damage caused by arcing.

As the moveable conductive blade 50 continues towards its second blade position (FIG. 5C), the moveable contact 60 initially touches and/or contacts (FIG. 5B) the contact 85 at one point and then causes the floating contact assembly 80 to self-adjust (e.g., the floating member 90 rotates and/or moves about one or more of the axes X, Y, and Z from the first rotated position (FIG. 5A) to the second rotated position (FIG. 5C)) such that the contact 85 and the moveable contact 60 physically contact each other at a minimum of three points. That is, the moveable contact 60 and the contact 85 meet each other in a planar engagement defining a contact plane that is defined by at least three points of contact between the exposed faces 62, 85*a* of the contacts 60, 85.

Essentially, the engagement of the floating contact assembly 80 by the moveable contact 60 causes the floating contact assembly 80 to move such that the exposed face 62 of the moveable contact 60 touches the exposed face 85*a* of the contact 85 as shown, for example, in FIG. 5C. The planar engagement of the contacts 60 and 85 between the exposed faces 62 and 85*a* results in the contacts touching at a minimum of three points. As the damage due to arcing is generally contained to the upper halves of the contacts 60, 85, the probability that there is a low or relatively lower electrical resistance path for electricity to flow through the contact connection is increased. Thus, the concentration of the arcing and resulting damage results in a contact-to-contact connection (e.g., moveable contact 60 to contact 85 connection in FIG. 5C) that has a relatively higher probability of at least one point of contact having relatively low electrical resistance.

The self-adjusting of the floating contact assembly 80 such that the contact 85 and the moveable contact 60 physically contact each other at a minimum of three points is also advantageous to account for and/or compensate for typical manufacturing variations on the exposed faces 85*a* and 62 and of the contacts 85, 60 generally, which can be caused by, for example, rough surface finishes, imperfections in contacts, non-parallel faces, etc.

Alternatively to the floating member 90 and the bearing element 95 being two separate and distinct components of the floating contact assembly 80, the bearing element 95 can be formed as an integral portion of the floating member 90 (not shown). Similarly, alternatively to the bearing element 95 and the housing 20 and the cover (not shown) of the circuit breaker 10 being separate and distinct components, the bearing element 95 can be formed as one or more integral portions of the housing 20 and/or of the cover (not shown).

While the floating member 90 is described and shown in the FIGS. as having a disc shape, the floating member 90 can any shape capable of having the contact 85 attached thereto. For example, the floating member 90 can have a circular disc shape, a square shape, an oval shape, a triangular shape, any combination thereof, etc.

Figure 6:
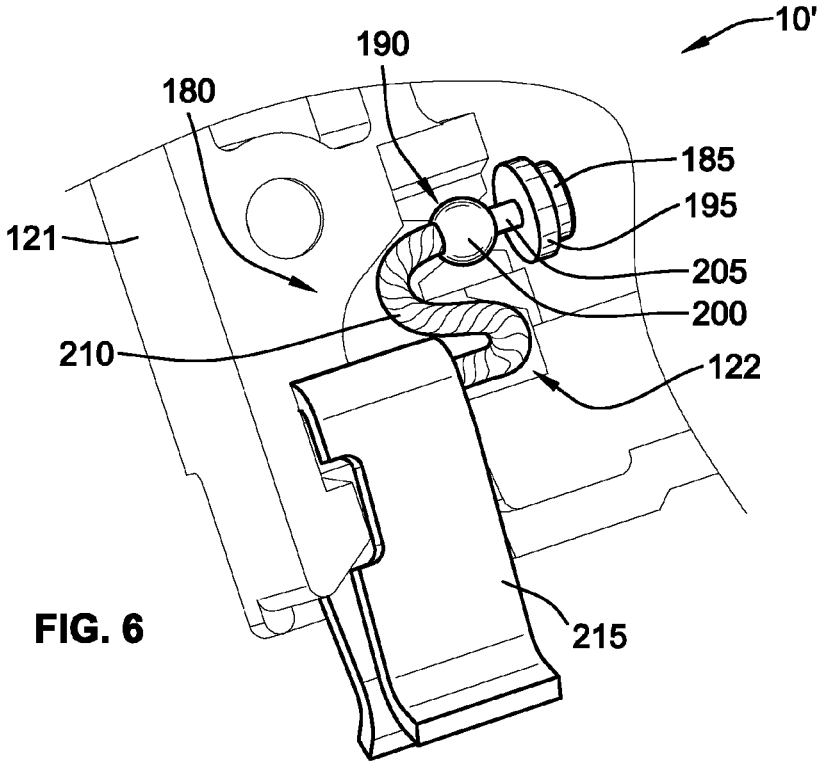
FIG. 6 is a partial perspective view of a portion of a circuit breaker including a floating contact assembly according to some aspects of the present disclosure.
Figure 7:
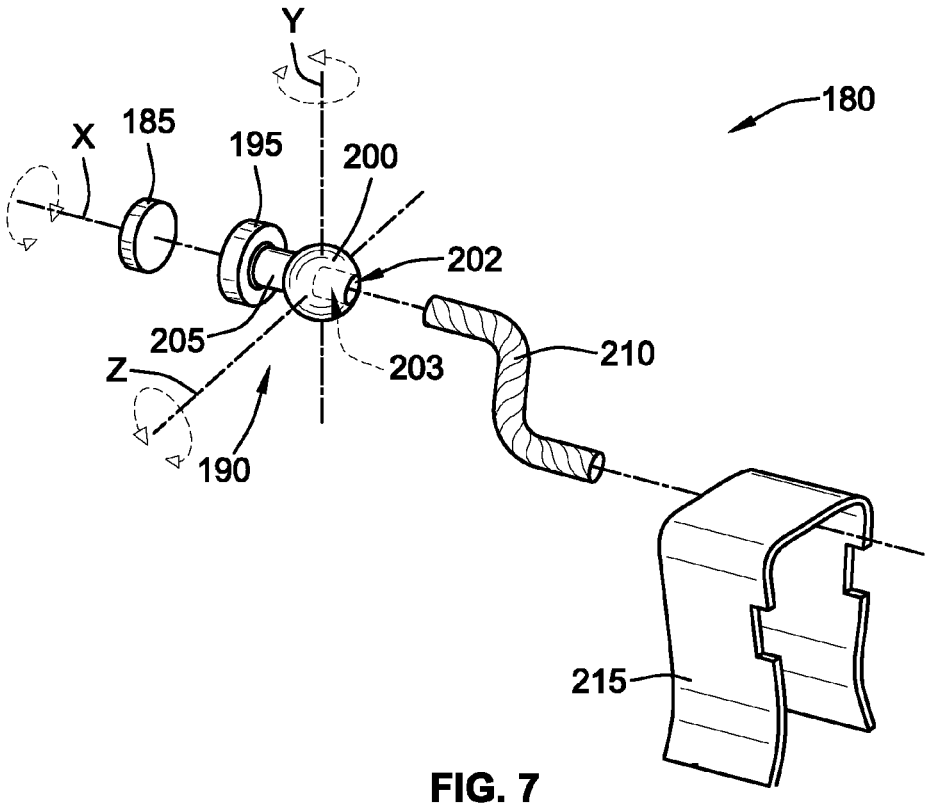
FIG. 7 is a perspective exploded view of the floating contact assembly of the circuit breaker of FIG. 6.
Figure 8:
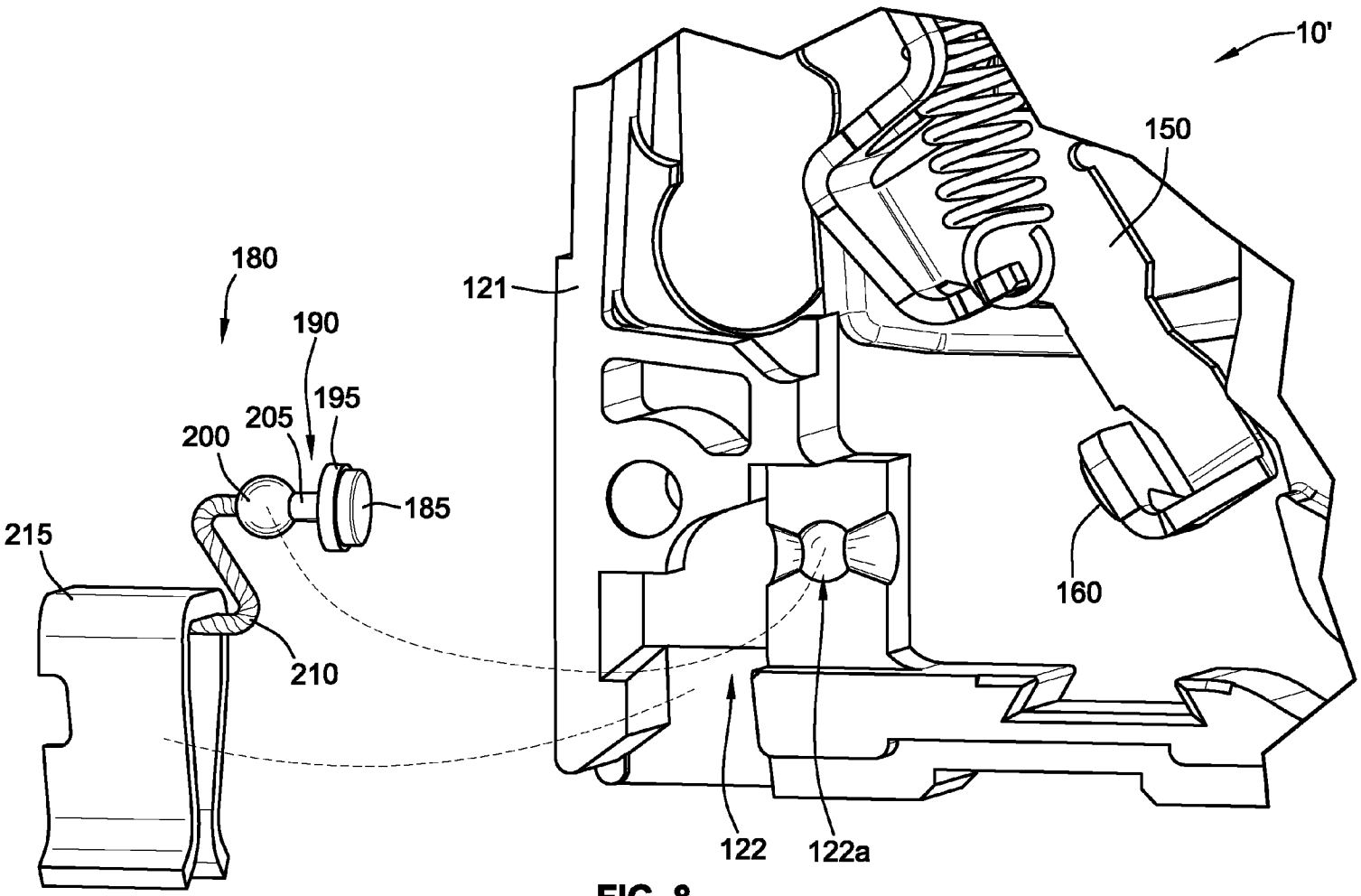
FIG. 8 is a partially exploded partial perspective view of the circuit breaker of FIG. 6.

Now referring generally to FIGS. 6-8, a floating contact assembly 180 is shown as being positioned within a housing 121 of a circuit breaker 10'. The circuit breaker 10' is similar to the circuit breaker 10 described above except that the housing 121 of the circuit breaker 10' is modified as compared with the housing 20 of the circuit breaker 10 to accommodate the differences in the floating contact assembly 180 as compared to the floating contact assembly 80 described above. However, the rest of the circuit breaker 10' is the same as, or similar to, the circuit breaker 10 described above. For example, the moveable contact blade 150 (FIG. 8) and the moveable contact 160 (FIG. 8) of the circuit breaker 10' are the same as, and operate in the same fashion as, the moveable contact blade 50 (FIG. 1) and the moveable contact 60 (FIG. 1) of the circuit breaker 10 described above.

As best shown in the exploded view of the floating contact assembly 180 of FIG. 7, the floating contact assembly 180 includes a contact 185, a bearing stud or a floating bearing stud 190, a flexible conductor 210, and a jaw member 215. The bearing stud 190 has a contact-connecting portion 195, a bearing portion 200, and a stud portion 205. The stud portion 205 connects the contact-connecting portion 195 to the bearing portion 200 such that bearing portion 200 is rigidly and electrically coupled to the contact-connecting portion 195 via the stud portion 205.

As best shown in FIG. 8, the contact 185 is physically and electrically coupled to the bearing stud 190. The contact 185 is attached to the contact-connecting portion 195 of the bearing stud 190 in the same, or similar, fashion that the contact 85 is attached to the floating member 90 described above.

The flexible conductor 210 is physically and electrically coupled to the bearing stud 190 and to the jaw member 215 such that the flexible conductor 210 electrically connects the jaw member 215 to the bearing stud 190. The flexible conductor 210 and the jaw member 215 are the same as, or similar to, the flexible conductor 100 and the jaw member 105 described above. The flexible conductor 210 can be physically attached to the jaw member 215 and the bearing stud 190 by any means known in the art for attaching two electrically conducting components.

As shown in FIG. 7, a portion of the flexible conductor 210 can be inserted through an aperture 202 and into an inner cavity 203 of the bearing portion 200 of the bearing stud 190. The bearing portion 200 can be, for example, crimped and/or otherwise physical modified (e.g., deformed from a first shape to a second shape, like from an oval shape to a spherical shape) to lock the portion of the flexible conductor 210 in physical contact with the bearing portion 200. Such a coupling of the flexible conductor 210 and the bearing portion 200 provides a reliable electrical connection between the flexible conductor 210 and the bearing stud 190. As the bearing stud 190 can be formed from any electrically conducting material, the jaw member 215 is electrically coupled to the contact 185.

In addition to electrically connecting the bearing stud 190 and the jaw member 215, the flexible conductor 210 can act as a spring so as to exert a force on the bearing stud 190 in the same, or similar, fashion that the flexible conductor 100 can act as a spring so as to exert a force on the floating member 90. For example, when the circuit breaker 10' is off (e.g., the moveable contact 160 and the contact 185 are not electrically connected), the flexible conductor 210 can bias the bearing stud 190 such that the bearing stud 190 is in a first rotated position. In the first rotated position, the bearing stud 190 is rotated about a Z axis (FIG. 7) such that the bearing stud 190 is at a first angle (not shown, but the same as, or similar to, the angle θ described above) with respect to the vertical. The bearing stud 190 can move and/or rotate from the first rotated position to a second rotated position (not shown, but the same as, or similar to, the angle shown in FIG. 5C in reference to the circuit breaker 10) due to, for example, a force exerted on the contact 185 by the moveable contact 160 and/or the moveable conductive blade 150.

As shown in FIG. 8, the housing 121 includes an interior surface that forms a floating-contact-assembly cavity 122 along with the cover (not shown), which includes a bearing cavity 122*a* therein. The bearing cavity 122*a* is sized and shaped to receive at least a portion of the bearing portion 200 of the bearing stud 190 therein such that the bearing stud 190 can rotate in a spherical fashion about a center of the bearing portion 200. By rotating in a spherical fashion, it is meant that the bearing stud 190 can rotate in all three degrees of freedom about the center or origin of the bearing portion 200. That is, the bearing stud 190 is free to rotate about the X, Y, and Z axes, positioned through the center of the bearing portion 200, as illustrated in FIG. 7. In some implementations, the bearing portion 200 can be positioned with the bearing cavity 122*a* of the housing 121 such that the interior surface of the housing 121 that forms the bearing cavity 122*a* abuts at least a portion of the bearing portion 200 to prevent the bearing portion 200 from substantially translating therein.

The contact-connecting portion 195 of the bearing stud 190 is spaced from the bearing cavity 122*a* due to, for example, the stud portion 205 and the size and shape of the bearing cavity 122*a*. Such spacing permits the contact-connecting portion 195 to rotate about one or more of the X, Y, and/or Z axes that pass through the bearing portion 200 of the bearing stud 190. That is, as the contact-connecting portion 195 of the bearing stud 190 is rigidly attached to the bearing portion 200, the contact-connecting portion 195 and the attached contact 185 are also free to rotate about the X, Y, and Z axes, positioned through the center of the bearing portion 200.

It is appreciated that the X, Y, and Z axes, about which the bearing stud 190 can rotate, can be positioned in any spatial location as the sizes and shapes of the bearing stud 190 are modified. Depending on the shape of the bearing portion 200, the housing 121 can have a corresponding interior surface forming a corresponding bearing cavity 122*a* to facilitate movement and/or rotation of the bearing stud 190 relative to the housing 121 such that the floating contact assembly 180 can self-adjust. That is, in response to the moveable contact 160 physically contacting the contact 185 (e.g., when the circuit breaker 10' is turned on), the bearing stud 190 is configured to self-adjust such that the contact 185 and the moveable contact 160 physically contact each other at a minimum of three points by the bearing stud 190 rotating about one or more of the X, Y, and/or Z axes.

While the bearing stud 190 is described as being free to rotate about the X, Y, and Z axes, in some implementations of the disclosed concepts, the bearing stud 190 is free to partially rotate about two orthogonal axes with two rotational degrees of freedom, such as, for example, the Y and Z axes due to, for example, the attachment of the flexible conductor 210 to the bearing portion 200. In some such implementations, the flexible conductor 210 is designed such that rotation of the bearing stud 190 about the X axis is merely constrained but not completely limited to zero rotation thereabout.

Words of degree such as "substantially" or "about" are used herein in the sense of "at, or nearly at, given the process, control, and material limitations inherent in the stated circumstances" and are used herein to keep the unscrupulous infringer from taking advantage of unqualified or absolute values stated for exemplary embodiments.

While particular implementations and applications of the present disclosure have been illustrated and described, it is to be understood that the disclosure is not limited to the precise construction and compositions disclosed herein and that various modifications, changes, and variations may be apparent from the foregoing descriptions without departing from the spirit and scope of the present disclosure as defined in the appended claims.

What is claimed is:

1. A floating contact assembly for use in a circuit breaker, the floating contact assembly comprising:

a contact;

a floating member including a joint surface, the contact being electrically connected to a surface of the floating member opposite the joint surface;

a bearing element configured to abut the joint surface of the floating member such that the floating member is configured to rotate about a first axis that passes through the bearing element;

a jaw member configured to electrically connect the floating contact assembly to an external electrical component; and a flexible conductor electrically coupling the jaw member to the floating member, the flexible conductor having one end extending away from the floating member and the bearing element toward the jaw member.

2. The floating contact assembly of claim 1, wherein the floating member is further configured to rotate about a second axis that passes through the bearing element and that is orthogonal to the first axis.

3. The floating contact assembly of claim 1, wherein the floating member is configured to rotate with respect to the bearing element with at least two rotational degrees of freedom.

4. The floating contact assembly of claim 1, wherein the joint surface of the floating member includes a concave portion that is configured to receive therein a corresponding convex portion of the bearing element.

5. The floating contact assembly of claim 1, wherein the bearing element has a spherical shape, a semi-spherical shape, a conical shape, a semi-conical shape, a pyramidal shape, a semi-pyramidal shape, a cylindrical shape, a semi-cylindrical shape, a 25 round shape, a semi-round shape, or any combination thereof.

6. A floating contact assembly for use in a circuit breaker, the floating contact assembly comprising:

a contact;

a floating member including a joint surface, the contact being electrically connected to a surface of the floating member opposite the joint surface;

a bearing element configured to abut the joint surface of the floating member such that the floating member is configured to rotate about a first axis that passes through the bearing element;

a jaw member configured to electrically connect the floating contact assembly to an external electrical component; and a flexible conductor electrically coupling the jaw member to the floating member, wherein the floating member is disc-shaped, and wherein the contact, the floating member, and the bearing element are configured to be coaxially aligned along an axis that defines a rotational degree of freedom of movement for the floating member relative to the bearing element such that the contact is configured to rotate with the floating member to be in a flush relationship with a corresponding moveable contact in response to the moveable contact being urged toward the contact, wherein the floating member, the contact, the flexible conductor, and the jaw member are made of an electrically conductive material, and wherein the jaw member includes a pair of legs configured to receive therebetween a terminal.

7. A circuit breaker, comprising:

a housing having a floating-contact-assembly cavity formed by at least one interior surface of the housing;

a handle at least partially protruding from the housing;

a moveable conductive blade positioned within the housing and operably coupled to the handle;

a moveable contact directly attached to the moveable conductive blade; and a floating contact assembly at least partially positioned within the floating-contact-assembly cavity, the floating contact assembly including:

a contact electrically coupled to a floating member and moveable with the floating member; and a bearing element coupled to the floating member such that the floating member is configured to move with respect to the housing, the movement of the floating member being limited by a geometry of the floating-contact-assembly cavity.

8. The circuit breaker of claim 7, wherein the floating member is configured to rotate within the floating-contact-assembly cavity and with respect to the bearing element with at least two rotational degrees of freedom.

9. The circuit breaker of claim 7, wherein the moveable conductive blade is operably coupled to the handle such that the moveable conductive blade is configured to move from a first blade position to a second blade position in response to the handle being urged from an OFF position to an ON position, the moveable contact being configured to physically contact the contact in response to the moveable conductive blade being in the second blade position.

10. The circuit breaker of claim 9, wherein in response to the moveable contact physically contacting the contact, the floating contact assembly is configured to self-adjust such that the contact and the moveable contact physically contact each other at a minimum of three points.

11. The circuit breaker of claim 10, wherein the floating contact assembly is 30 further configured to self-adjust upon disengagement of the contact by the moveable contact in response to the handle being urged from the ON position to the OFF position.

12. A circuit breaker, comprising:

a housing having a floating-contact-assembly cavity formed by at least one interior surface of the housing;

a handle at least partially protruding from the housing;

a moveable conductive blade positioned within the housing and operably coupled to the handle;

a moveable contact directly attached to the moveable conductive blade; and a floating contact assembly at least partially positioned within the floating-contact-assembly cavity, the floating contact assembly including:

a contact electrically coupled to a floating member;

a bearing element coupled to the floating member such that the floating member is configured to move with respect to the housing; and a flexible conductor attached to the floating member and to a jaw member such that flexible conductor electrically connects the floating member to the jaw member, the jaw member being configured to electrically connect the circuit breaker to an external electrical component.

13. The circuit breaker of claim 12, wherein the flexible conductor exerts a first force on the floating member that biases the floating member towards a first position and in response to the moveable contact blade being in the second blade position, the moveable contact is configured to exert a second force on the contact such that the floating member moves from the first position towards a second position.

14. The circuit breaker of claim 7, wherein the bearing element includes one or more portions that is integrally formed with one or more portions of the housing.

15. The circuit breaker of claim 7, wherein the floating member includes a joint surface, the contact being electrically connected to a surface of the floating member opposite the joint surface, the opposing surface including a tapered portion such that the contact at least partially protrudes from the floating-contact-assembly cavity.

16. The circuit breaker of claim 7, wherein the floating member includes a joint surface, the contact being electrically connected to a surface of the floating member opposite the joint surface, the bearing element being coupled to the joint surface of the floating member in an abutting fashion such that the floating member is further configured to move with respect to the bearing element.

17. The circuit breaker of claim 7, wherein the bearing element is integrally formed with the floating member such that the floating member is further configured to move in a fixed relationship with the bearing element and such that the bearing element is electrically connected to the floating member.

18. The circuit breaker of claim 17, further comprising a flexible conductor attached to a jaw member and the bearing element such that flexible conductor electrically connects the jaw member to the bearing element, the jaw member being configured to electrically connect the circuit breaker to an external electrical component.

19. A circuit breaker, comprising:

a housing having a bearing cavity formed by at least one interior surface of the housing;

a jaw member partially protruding from the housing and being configured to electrically connect the circuit breaker to an external electrical component;

a flexible conductor electrically coupled to the jaw member;

a bearing stud having a bearing portion rigidly and electrically coupled to a contact-connecting portion, the bearing portion being positioned with the bearing cavity of the housing, the bearing portion having an aperture leading to an interior cavity that is configured to receive a portion of the flexible conductor for electrically connecting the jaw member to the bearing stud, the contact-connecting portion being spaced from the bearing cavity and being configured to rotate about a first axis that passes through the bearing portion of the bearing stud;

a contact electrically connected to the contact-connecting portion of the bearing stud;

a moveable conductive blade positioned within the housing; and a moveable contact configured to physically contact the contact and being directly attached to the moveable conductive blade.

20. The circuit breaker of claim 19, wherein the bearing portion is rigidly and electrically coupled to the contact-connecting portion via a stud portion, the contact-connecting portion of the bearing stud being further configured to rotate about a second axis that passes through the bearing portion that is orthogonal to the first axis, the bearing portion being positioned with the bearing cavity of the housing such that the at least one interior surface of the housing forming the bearing cavity abuts at least a portion of the bearing portion and is configured to prevent the bearing portion from substantially translating, and in response to the moveable contact physically contacting the contact, the bearing stud is configured to self-adjust such that the contact and the moveable contact physically contact each other at a minimum of three points.

21. The floating contact assembly of claim 1, wherein the flexible conductor is an electrical wire.

* * * * *